US006295365B1

(12) United States Patent
Ota

(10) Patent No.: US 6,295,365 B1
(45) Date of Patent: Sep. 25, 2001

(54) ACOUSTIC SENSOR AND ELECTRIC STETHOSCOPE DEVICE INCORPORATING THE SAME THEREIN

(76) Inventor: Haruyoshi Ota, 4-20-8, Naka-arai, 359-0041 Tokorozawa-shi, Saitama-ken (JP)

( * ) Notice: Subject to any disclaimer, the term of this patent is extended or adjusted under 35 U.S.C. 154(b) by 0 days.

(21) Appl. No.: 09/432,149

(22) Filed: Nov. 2, 1999

(30) Foreign Application Priority Data

Nov. 6, 1998 (JP) ..... 10-332073

(51) Int. Cl.[7] ..... H04R 3/00

(52) U.S. Cl. ..... 381/114; 381/173; 381/190; 381/67

(58) Field of Search ..... 381/111, 114, 381/173, 369, 190, 67

(56) References Cited

U.S. PATENT DOCUMENTS 4,258,229 * 3/1981 Eggert ..... 381/67
4,295,471 * 10/1981 Kaspari ..... 381/67
5,539,831 * 7/1996 Harley ..... 381/190

* cited by examiner

*Primary Examiner*—Minsun Oh Harvey
(74) *Attorney, Agent, or Firm*—Rabin & Berdo, P.C.

(57) ABSTRACT

An acoustic sensor includes the following: a piezoelectric element constituted of a piezoelectric substance on which at least one electrode is provided, and a diaphragm on which the piezoelectric substance is mounted and supported; a membrane capable of vibrating, which is arranged in a position opposite to the diaphragm; a frame which is so horn-shaped that the interior space is enlarged from the edge of the membrane to the edge of the diaphragm; a cell constituted by arranging the frame in such a way as to house the diaphragm therein, expose the membrane to the outside, and enclose an electrically insulating liquid hermetically therein; and a lead connected to the electrode and drawn out from the electrode to the outside of the frame.

4 Claims, 12 Drawing Sheets

SENSITIVITY DIFFERENCE BETWEEN 1.16 kHz/4.6kHz
TWO FREQUENCY TYPE AND P-TYPE
(REFERENCE : P-TYPE)

ACOUSTIC SENSOR AND ELECTRIC STETHOSCOPE DEVICE INCORPORATING THE SAME THEREIN

REFERENCE TO RELATED APPLICATION

This application claims the priority right under 35 U.S.C 119, of Japanese Patent Application No. Hei 10-32073 filed on Nov. 6, 1998, the entire disclosure of which is incorporated herein by reference.

BACKGROUND OF THE INVENTION

1. Field of the Invention

The present invention relates to an acoustic sensor for detecting faint sounds by means of transmission stably with high sensitivity, and an electronic stethoscope device incorporating the same therein. The faint acoustic sounds include a heart sound, a lung sound caused by a polyp in a bronchial tube, a sound of water leakage through cracks in a water main laid under the ground, an acoustic emission (AE), and a sound in a spectrum of seismic waves.

2. Description of Related Art

For convenience in explaining the invention, a range of acoustic frequencies is divided into three sound ranges: a low sound range of 30 to 500 Hz, a middle sound range of 300 Hz to 3 kHz, and a high sound range of 1.5 to 7 kHz. There is no intention to divide the range of acoustic frequencies precisely because the edges of the sound ranges overlapped one another.

In a clinical diagnosis, an airborne-type acoustic sensor, typified by a stethoscope, Is used, almost without exception, to detect sounds within a body under examination, the sounds ranging from a low frequency heart sound to a high frequency lung sound.

The stethoscope, however, causes some −6 dB/oct of roll-off in an airborne sound path from a chest piece to ear chips through rubber tubes. Inevitably, the sensitivity is significantly deteriorated in the high sound range, and this makes it difficult to detect a high frequency body sound, such as a sound from the lungs.

To solve the problem, a peaking method may be adapted, which uses a multi-resonance characteristic appearing when the airborne sound path is regarded as a sound tube. The multi-resonance peaking method results in an improvement of the sensitivity to resonant frequencies, but it is accompanied by significant deterioration of sensitivity in a non-resonant frequency range, resulting in impairment of efforts to the frequency sensitivity characteristics. In addition, the sound tube has a fundamental drawback that resonant frequencies are susceptible to changes in ambient temperature. FIG. 15 shows frequency sensitivity characteristics of a typical stethoscope using a peaking method.

As shown with a dashed-line circle in FIG. 15, multi-point peaking that uses resonance effects of the sound tube compensates for frequency sensitivity characteristics in a mid-frequency sound range.

Alternatively, a highly sensitive acoustic sensor, such as a lung sound sensor, may be used, in which a body sound under examination is detected using a stethoscope designed for exclusive use in a high frequency sound range, picked up by a highly sensitive capacitor microphone, highly amplified and then signal-processed. Yet the system cannot avoid ambient noises: a problem that remains unresolved. The problem is that, even if the frequency sensitivity characteristics of the body sound under examination are compensated by making the best use of signal processing means, including an equalizer and a filter, it is physically impossible to flatten the frequency sensitivity characteristics.

Problems related to conventional stethoscopes have remained unsolved after all, regardless of which of the proposed solutions is adopted. The problems have also been the biggest stumbling block to common use of a database in which wave data of examined body sounds are stored.

Conventional, electronic stethoscopes have such basic structural requirements that a combination of a capacitor microphone and a variable amplifier is incorporated. Such conventional, electronic stethoscope devices are disclosed, for example, in Japanese Patent Laid-open Application Nos. 53-30187, 55-54938, 61-253046, 62-1486531 and 63-135142, Japanese Patent Published Application No. 63-501618, Japanese Patent Laid-open Application Nos. 01-29250 and 02-172449, Japanese Utility-model Laid-open Application No. 03-91310, and M4504A product catalogue of Hewlet Packard company. Those disclosed in the above documents are all configured on the basis of the basic structural requirements.

Another example of related art is disclosed in Japanese Patent Laid-open Application No. 10-258053. This electronic stethoscope device features, instead of the conventional stethoscope, the use of an electret and a pickup, similar to the capacitor microphone, that uses an air gap between the electret and an opposed electrode provided on the body side.

Still another example of related art is disclosed in Japanese Patent Laid-open Application No.10-229984. This electronic stethoscope device features a water bag between an ultrasonic transducer and the body of a patient under examination, so that the focal point of an ultrasonic beam can be adjusted, thereby making an osteoporosis diagnosis of a particular part of the patient with a high degree of precision.

As discussed above, the electronic stethoscope devices provided with the conventional acoustic sensors all use an airborne acoustic sensor, typified by the stethoscope, in which the body sound under examination is transmitted from the body surface to an air layer. The sound waves traveling through the air are picked up by he capacitor microphone, and converted into an electric signal. The electric signal is then amplified and processed.

The following explains the principle of such a stethoscope device mainly used in auscultation examinations. The explanation can also be applied to other techniques for detecting the sounds of leaking, an AE and a seismic sound, merely by reading, as an elastic solid of adequate material, a body of viscous fluid, substantially the same as water, that is subjected to examinations.

From the viewpoint of acoustics, a difference in specific acoustic impedance (hereinbelow, simply referred to as acoustic impedance) between the body and air makes the body sound reflected when it is transmitted from the body surface to the air layer. The reflection loss may be 30 dB or more.

FIG. 14 is a schematic diagram illustrating a sound propagat on system from the body to an acoustic conversion means through a propagation means. In the drawing, if there is a difference in acoustic impedance (Za, Zb, Zc) between the body and the propagation means, or between the propagation means and the acoustic conversion means, the sound is reflected in the boundary at a reflectivity $\gamma$ given by equation (1) that shows a case where the difference concerned takes place between Z1 and Z2. and $\alpha$=Z2/Z1.

$$\gamma = \left[\frac{Z_1 - Z_2}{Z_1 + Z_2}\right]^2 = \left[\frac{1-\alpha}{1+\alpha}\right]^2 \quad (1)$$

For example, the reflectivity γ is 0.999 between water and air, 0.934 between ceramic and water, or 0.227 between silicon and water. It can be found that the homeomorphous relation between silicon and water has the advantage over the other combinations.

The problem of reflection control also arises with an ultrasonic probe for medical use. This is because the same thing takes place in a heteromorphous relation between liquid and solid in the same way as the relation between liquid and gas in the stethoscope. To solve the problem, a viscous gel has been applied to,the probe before putting the same on the examinee in medical examinations. This solution, however, causes more desensitization and instability for the following reason: The viscous gel is open to the air, and the gel pressure never exceeds the barometric pressure. Therefore, the examiner has no other choice but to apply strong pressure to the examinee.

The intervention of a closed water bag such as one disclosed in Japanese Patent Laid-open Application No. 10-229984 is desirable in terms of acoustic impedance matching because the boundary between homeomorphous liquids can be formed on the body surface. Yet the problem remains unresolved on the other surface that contacts the probe, and it can be said that the position in question is just shifted to the other one. In fact, the intervention of the closed water bag does nothing but adjust the focal length.

In addition, the capacitor microphone has a higher sensitivity; it detects more ambient noises together with the body sound under examination. The higher the sensitivity, the quieter the examination environment should be kept.

That is why water leakage checks on water mains laid under ground are carried out at midnight because of reduced ambient noise.

The diameter of a chest piece of the stethoscope may be made larger to enhance the sensitivity. An excessively large diameter, however, causes remarkable desensitization in the high frequency sound range due to a phase difference caused by non-uniform wave motion in the bore, or uneven propagation lengths, or due to frequency characteristics in the air-borne sound path. In fact, it is set to a proper value within the range of 30 to 50 mmϕ. Of course, the use of a diaphragm allows the air layer to be sealed effectively, and this improves the sensitivity by several dB. Yet this solution is not essential.

SUMMARY OF THE INVENTION

The present invention has been made to solve the above problems accompanying the detection methods used with the conventional stethoscopes. It is an object of the present invention to provide an electronic stethoscope device that comprises an acoustic sensor exhibiting an ideally homeomorphous relation with an object or body to be examined, so that it can reduce the amount of reflection, and resist changes in ambient temperature and mixing of ambient noise, thereby operating on a rational principle over a wide range of frequencies with highly sensitive, flat frequency characteristics.

The acoustic sensor of the present invention is such that a piezoelectric element, constituted of a diaphragm and piezoelectric substances having surfaces each of which has at least one electrode mounted thereon, is retained in the center of a frame having a horn-shape inward. Further, two membranes facing each other are bonded on respectively opposite ends of the frame to form a cell, an electrical insulating liquid is hermetically enclosed in the cell, and leads are drawn out from the electrodes to the outside.

According to the present invention, there is also provided an electronic stethoscope device for detecting an object or body sound under examination, wherein a sensor part, constituted by arranging a contact piece on the object-side membrane of the acoustic sensor of the present invention, is electrically connected to an amplifier part, constituted by electrically connecting an earphone terminal, an external terminal and a variable resistor to an amplifier, and further to a power supply part, constituted of a push-on switch and a battery port. All the parts are held in a vessel.

The following explains how the sensor of the present invention works, from viewpoints of both fluidics and acoustics.

At first, from the viewpoint of fluidics, FIG. 9 illustrates how a diffuser works.

The diffuser is known as an energy converter that converts velocity of a closed fluid system into pressure. Equation (2) is established from Bernoulli law for incompressible liquid. If a uniform lamellar flow exists, equation (3) is obtained immediately from equation (2).

$$p+\tfrac{1}{2}\rho v^2+U=\text{constant} \quad (2)$$

potential energy U=constant $$P1+\tfrac{1}{2}\rho v_1^2=p2+\tfrac{1}{2}\rho v2^2 \quad (3)$$

In the above equations, p1, v1 and p2, v2 represent pressure and velocity at input and output ends of the diffuser, respectively, and ρ represents liquid density. If velocity on the input side is all converted into pressure, equation (4) will be established, where the velocity is converted into a pressure proportional to the square of the velocity.

$$p2=\tfrac{1}{2}\rho v_1^2 \quad (4)$$

Next, from the viewpoint of acoustics, the following explains how the acoustic sensor works, where the acoustic sensor of the present invention is transferred to an equivalent electric circuit.

FIG. 8 is a diagram for explaining how the acoustic sensor of the present invention works.

It is assumed here that membranes 12 and a piezoelectric element 23 slightly vibrate like a piston. In actuality, it is necessary to approximate to a cylindrical function; but both can be designed on the basis of piston vibration analysis, partly because their vibrations are minute, partly because vibration wavelengths are several times larger than the dimensions of the acoustic sensor.

The acoustic sensor shown in the sectional view of FIG. 8 is configured as follows: The piezoelectric element 23 having a diaphragm 15 with an effective area S2 is retained in the center of the interior space surrounded by two membranes 12, 12 with an effective area S1 and two frames 11, 11. The interior space is hermetically filled with an electrical insulating liquid 14.

Using FIG. 8, the following first discusses a case where the acoustic sensor operates unsymmetrically with one membrane 12 and the piezoelectric element 23 together with the diaphram 15. Assuming that an acoustic impedance z1 of the electrical insulating liquid 14 and the membrane 12 vibrate constantly at an angular frequency ω of a particle velocity $\dot{\xi}1$ (time differential of a displacement ξ1) with respect to the membrane 12, and that the piezoelectric element 23 with an acoustic impedance z2 is simultaneously excited at a particle velocity $\dot{\xi}2$, Hamilton function H is defined as equation (5) with a bulk modulus k.

$$H = \frac{1}{2} z_1 \dot{\xi}_1^2 + \frac{1}{2} z_2 \dot{\xi}_2^2 + j\omega \frac{1}{2} k \frac{(S_1\xi_1 - S_2\xi_2)^2}{V} \tag{5}$$

From this Hamilton function H, the sound pressure F1 of the membrane 12 and the sound pressure F2 of the piezoelectric element 23 are given by equation (6), and their operating equations are given by (7) and (8), respectively.

$$\frac{\partial H}{\partial \dot{\xi}_1} = F_1, \frac{\partial H}{\partial \dot{\xi}_2} = F_2 \tag{6}$$

$$z_1\dot{\xi}_1 + \frac{1}{j\omega}\frac{kS_1^2}{V}\dot{\xi}_1 - \frac{1}{j\omega}\frac{kS_1S_2}{V}\dot{\xi}_2 = F_1 \tag{7}$$

$$z_2\dot{\xi}_2 + \frac{1}{j\omega}\frac{kS_2^2}{V}\dot{\xi}_2 - \frac{1}{j\omega}\frac{kS_1S_2}{V}\dot{\xi}_1 = F_2 \tag{8}$$

Further, if $\alpha$=S2/s1, and C=V/kS1$^2$, where V is the volume of the electrical insulating liquid 14 surrounded by the membrane 12, the piezoelectric element 23 together with the diaphrom 15 and the frame 11, the above operating equations can be modified into equations (9) and (10). Thus, the presentation of the equivalent circuit as shown in FIG. 10 is obtained.

$$z_1\dot{\xi}_1 + \frac{1}{j\omega C}(\dot{\xi}_1 - \alpha\dot{\xi}_2) = F_2 \tag{9}$$

$$\frac{z_2}{\alpha^2}\alpha\dot{\xi}_2 + \frac{1}{j\omega C}(\alpha\dot{\xi}_2 - \dot{\xi}_1) = \frac{F_2}{\alpha} \tag{10}$$

As shown in FIG. 8. the acoustic sensor is configured to be symmetrical about the sectional center in order to prevent internal reflection of waves incident on the piezoelectric element 23, and make the piezoelectric element 23 operate without resonance across a wide-band frequency range. In this case, the acoustic impedance Z2 of the piezoelectric element 23 is replaced by a value, Z2/2, half of the acoustic impedance Z2, thus obtaining an equivalent circuit, such as one shown in FIG. 11, where circuits equal to each other In both input and output are symmetrically connected about the center.

Next, assuming that the two membranes 12, 12 are free from the sound pressure to vibrate, the natural frequency f is determined as follows. The natural frequency Is equal to the resonant frequency generated when the above equivalent circuit is short-circuited at both ends. In an F matrix of equation (13) obtained from equations (11) and (12), If F1=0, F2=0, and 2AB=0, the results are given by equations (14) and (15).

$$F_1 = -\left(\frac{1}{\alpha} + \frac{Z_1Y_1}{\alpha}\right)F_2 + \left(\frac{Z_1Z_2Y_1}{\alpha} + \alpha Z_1 + \frac{Z_1}{\alpha}\right)\xi_2 \tag{11}$$

$$\xi_1 = -\frac{Y_1}{\alpha}F_2 + \left(\frac{Z_2Y_1}{\alpha} + \alpha\right)\xi_2 \tag{12}$$

-continued $$\begin{pmatrix} A, & B \\ C, & D \end{pmatrix} = \begin{pmatrix} -\left(\frac{1}{\alpha} + \frac{Z_1Y_1}{\alpha}\right), & \left(\frac{Z_1Z_2Y_1}{\alpha} + \alpha Z_1 + \frac{Z_1}{\alpha}\right) \\ -\frac{Y_1}{\alpha}, & \left(\frac{Z_2Y_1}{\alpha} + \alpha\right) \end{pmatrix} \tag{13}$$

$$Z_2 = -\frac{2(1+\alpha^2)}{Y_1} = j\frac{2kS_1^2(1+\alpha^2)}{\omega V} \quad \text{or,} \tag{14}$$

$$Z_1 = -\frac{1}{Y_1} = j\frac{kS_1^2}{\omega V} \tag{15}$$

From the results, the relation between the acoustic impedance ratio Z2/Z1 and the area ratio $\alpha$=S2/S1 is given by equation (16), and the natural frequency f is given by equation (17) as Z1=j$\omega$M (M is mass of the electrical insulating liquid 14 of volume V).

$$\frac{Z_2}{Z_1} = 2(1+\alpha^2) \tag{16}$$

$$f = \frac{a^2}{8V}\sqrt{\frac{k}{\rho}} = \frac{a^2}{8V}c = \frac{S_1}{2\pi V}c \tag{17}$$

Both equations are effective design formulas: equation (16) gives an acoustic impedance matching value; equation (17) gives a detection peak frequency. Specifically, matching of the heteromorphous relation between the piezoelectric substance 13 and the electrical insulating liquid 14, and the maximum natural frequency (mechanically resonant frequency) of the acoustic sensor can be set by these design formulas.

If the wavelength is several times larger than the dimensions of the frame 11, design formulas for plane waves can be used as they are without consideration of the phase difference caused by the difference in length of the propagation path. On the other hand, if the wavelength is such that the frequency exceeds a high sound range comparable with the dimensions of the frame 11, it becomes necessary to use a different analysis in a slightly different configuration.

BRIEF DESCRIPTION OF THE DRAWINGS

By way of example and to make the description more clear, reference is made to the accompanying drawings, in which.

DETAILED DESCRIPTION OF THE PREFERRED EMBODIMENTS

Referring now to the accompanying drawings, preferred embodiments of the present invention will be described.

FIGS. 1 through 6 show typical embodiments of acoustic sensors according to the present invention.

Figure 1:
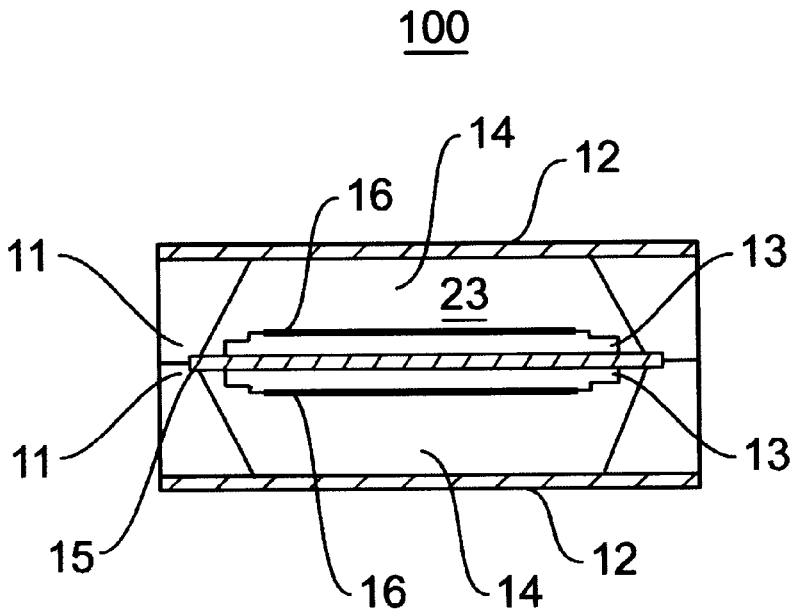
FIG. 1 is a sectional view illustrating an embodiment of an acoustic sensor according to the present invention.
Figure 4:
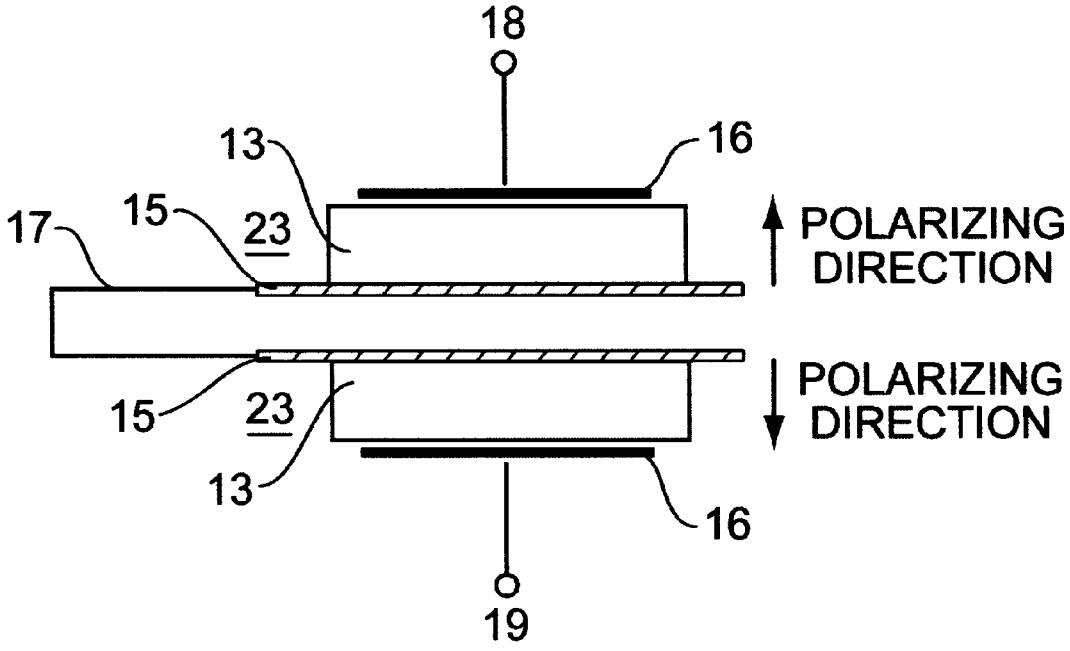
FIG. 4 is an enlarged sectional view of a piezoelectric element of the acoustic sensor of FIG. 3, illustrating polarizing directions of the piezoelectric element and a connection between electrodes.
Figure 6:
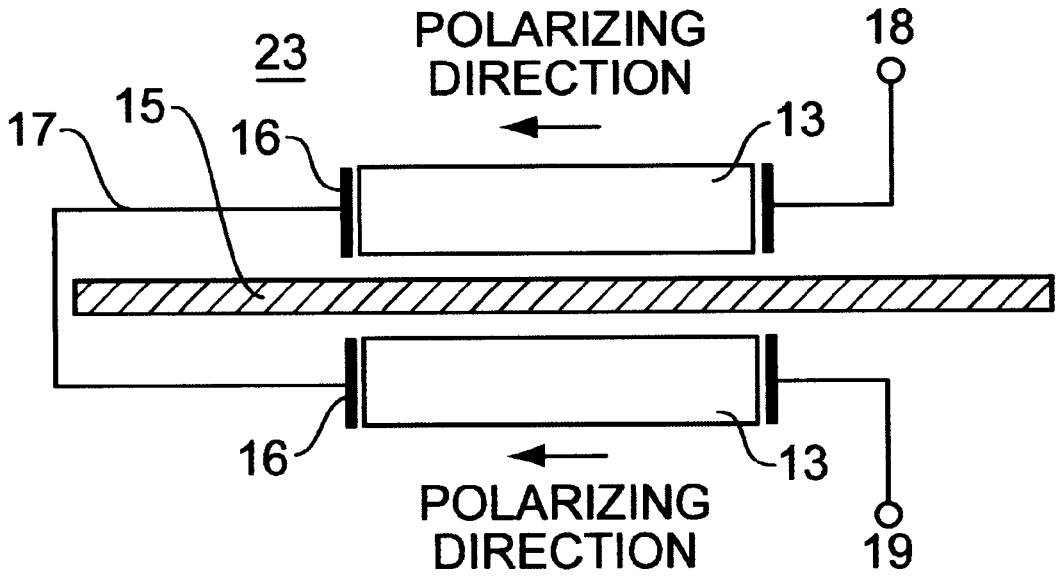
FIG. 6 is an enlarged sectional view of a piezoelectric element of the acoustic sensor of FIG. 5, illustrating polarizing directions of the piezoelectric element and a connection between electrodes.

An acoustic sensor 100 of FIG. 1 is configured such that cylindrical frames 11, 11 are joined together in the center, and a diaphragm 15, also serving as a support plate, is retained in the center, and both ends of the cylindrical frames 11, 11 are hermetically closed with membranes 12, 12. The diaphragm 15 is a thin plate of metal or plastic. Piezoelectric substances 13, 13, which are polarized along to the direction as indicated in FIG. 2, 4, and 6, and on the surfaces of which opposed electrodes 16, 16 are deposited, are bonded on both faces of the diaphragm 15 to form a piezoelectric element 23.

The membranes 12 are thin films, made of Plabun (trade name),Epoxy-Tetron (trade name) or Lumirror (trade name) with an experimentally determined thickness of 0.2 to 0.25 mm, which are bonded on the frames 11 to maintain proper tension.

The inside of the frames 11, 11 is horn-shaped to enlarge the interior space toward the center, and a low-viscosity, electrical insulating liquid 14, such as silicon oil, spindle oil or liquid paraffin, is hermetically enclosed therein. The electrical insulating liquid 14 is operative to transmit, to the piezoelectric element 23, acoustic vibrations transmitted from an unillustrated body under examination to the membrane 12.

Figure 2:
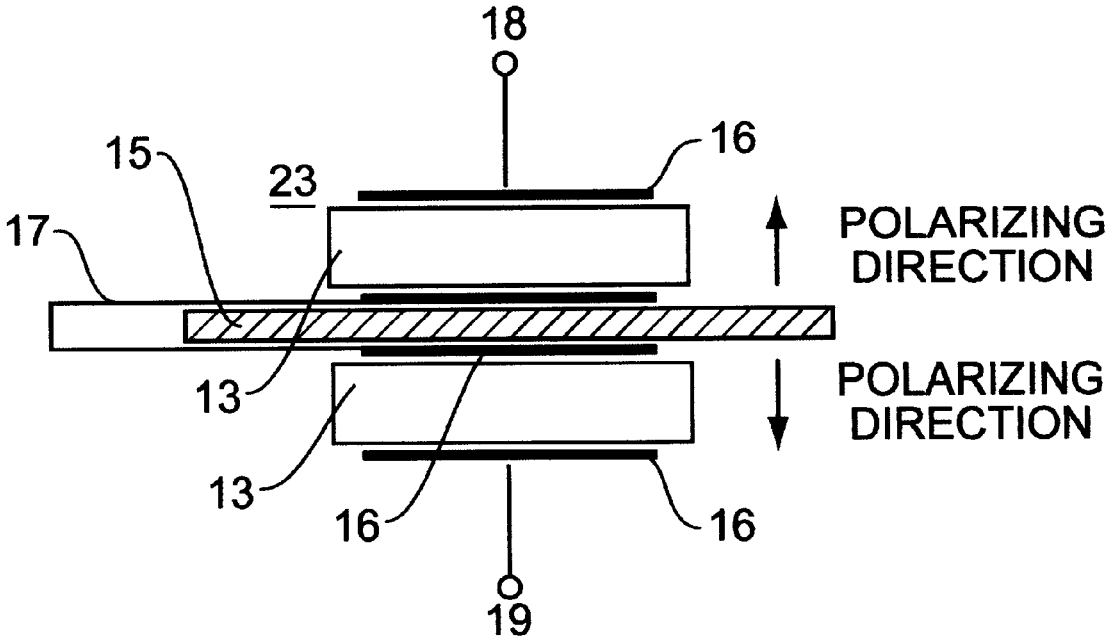
FIG. 2 is an enlarged sectional view of a piezoelectric element of the acoustic sensor of FIG. 1, illustrating polarizing directions of the piezoelectric element and a connection between electrodes.

FIG. 2 is an enlarged view illustrating detailed arrangements of the piezoelectric element 23 and a connection of the electrodes 16. Masses 13 of a piezoelectric substance, which are polarized in the vertical direction, are bonded on both faces of the diaphragm 15 so that the front and back faces of the diaphragm 15 have reversed directions of polarization. The electrodes 16 are internally connected in series, and connected to external lead electrodes 18, 19, respectively.

Figure 3:
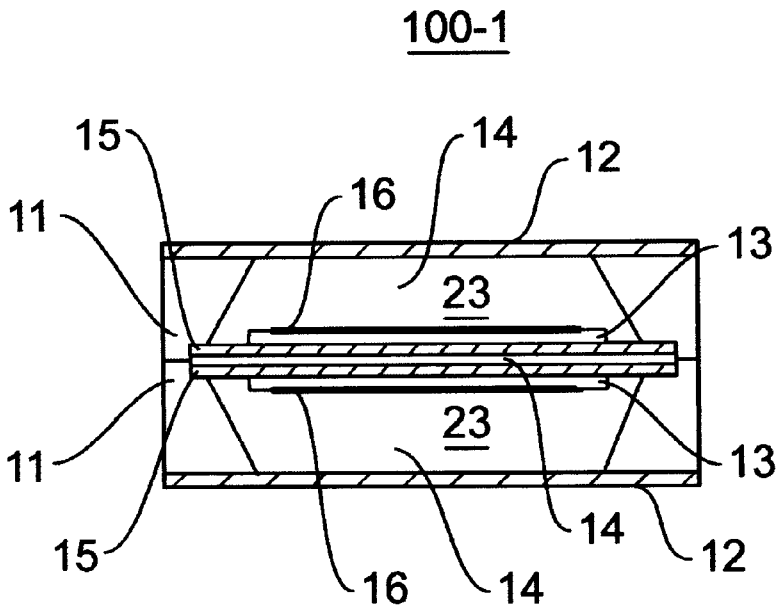
FIG. 3 is a sectional view illustrating another embodiment of an acoustic sensor according to the present invention.

An acoustic sensor 100-1 shown in FIG. 3 has a piezoelectric element configuration different from that of FIG. 1, in which two piezoelectric elements, each of which is made up by bonding a mass of piezoelectric substance 13 on one side of a diaphragm 15, are retained in parallel inside the frames 11. The other parts are the same as those in FIG. 1. The, frames 11 are joined together in the center after the membranes 12 and the piezoelectric elements are mounded therein. Further, the piezoelectric elements are internally connected together through a common wire 17. Such a configuration makes it easy to manufacture the acoustic sensor. FIG. 4 is an enlarged view illustrating detailed arrangements of the piezoelectric elements and a connection of the electrodes 16.

In this case, since Z2 is already divided into two, the coefficient of 2 in equation (16) needs to be changed to 1, but nothing is changed in equation (17).

If the diaphragms 15 are made of metal, they can also serve as the electrodes 16, and this makes the configuration simpler. Further, materials different in acoustic impedance can be used for the respective piezoelectric substances 13 so that a wide-band characteristic can be obtained. This case, however, has the disadvantage of producing a dip in sensitivity at low frequencies because of a slight delay of acoustic transmission to the two piezoelectric elements.

Though not shown in FIGS. 1 through 4, the diaphragm 15 has small bores therein so that a constant static pressure of hermetically enclosed electrically insulating liquid 14 is maintained equally in the frame 11, 11.

Figure 5:
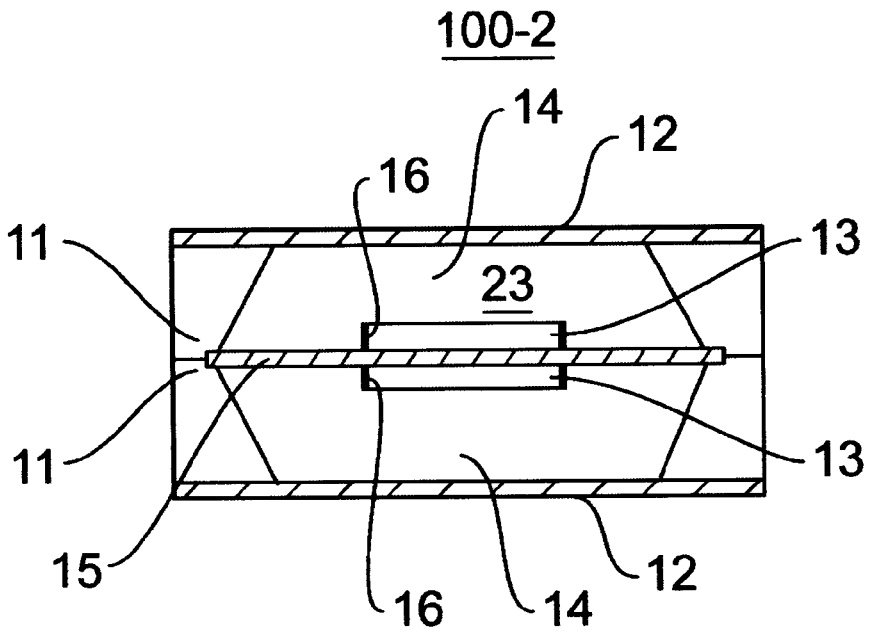
FIG. 5 is a sectional view illustrating still another embodiment of an acoustic sensor according to the present invention.

An acoustic sensor 100-2 of FIG. 5 has a piezoelectric element configuration different from those of FIGS. 1 and 4. As shown, a piezoelectric element is configured such that piezoelectric substances 13 polarized in parallel in the same direction are bounded on both faces of an imperforate, plastic diaphragm 15, and held in the frame 11. The other parts are the same as those shown in FIGS. 1 through 4.

In the piezoelectric element 23, vibrations of one membrane 12 causes an unsymmetrical vibration-sound pressure in the electrical insulating liquid 14, and distorts and displaces the diaphragm 15 to expand and contract the piezoelectric substances 13 bonded on the both faces of the diaphragm 15. The expansion and contraction of the piezoelectric substances 13 generates a vibration voltage which is output from respective electrodes 16 of the piezoelectric substances 13 to external lead electrodes 18, 19 through a connection wire 17.

On the one hand, the piezoelectric element features high voltage and high impedance; on the other hand, the element makes it difficult to obtain the balance of static pressure in the acoustic sensor, so that a low-frequency drift noises can be generated easily. Despite this drawback, the piezoelectric element has the advantages of downsizing the acoustic sensor and excellent performance in detecting low frequencies.

The frame 11 is not limited to the cylindrical shape, and it may be a hexahedron.

Figure 7:
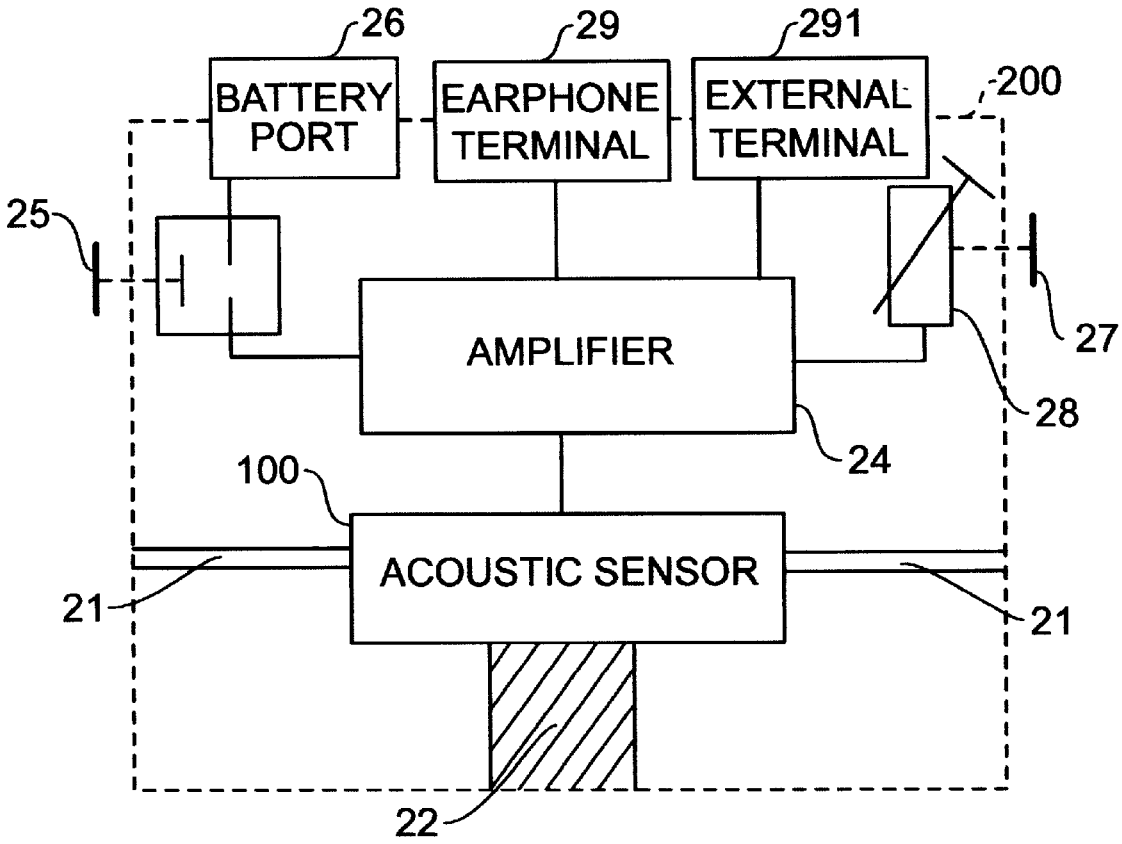
FIG. 7 is a circuit block diagram illustrating an embodiment of an electronic stethoscope device according to the present invention.
Figure 8:
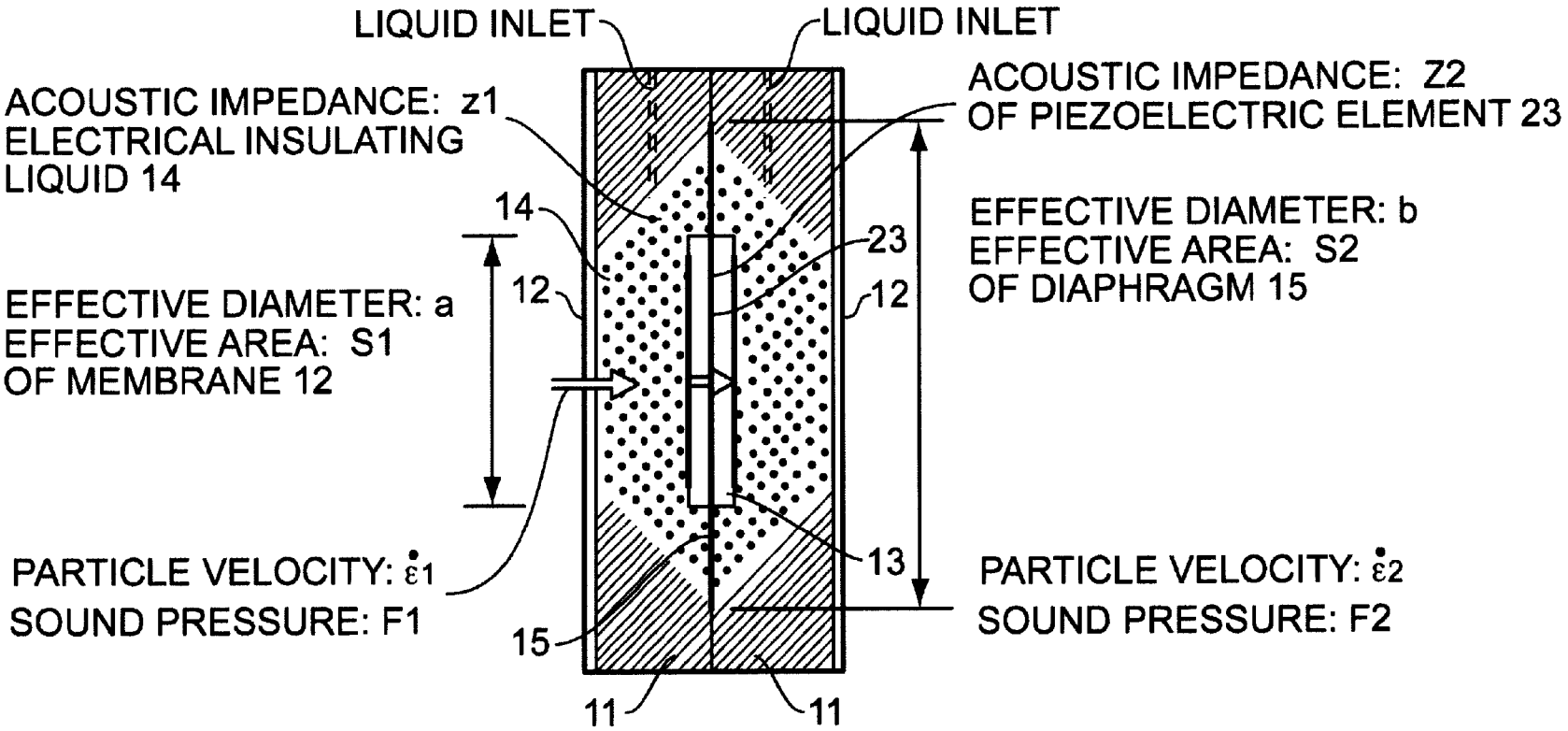
FIG. 8 is a sectional view for explaining how the acoustic sensor of the present invention works, taking the acoustic sensor of FIG. 1 by way of example.
Figure 9:
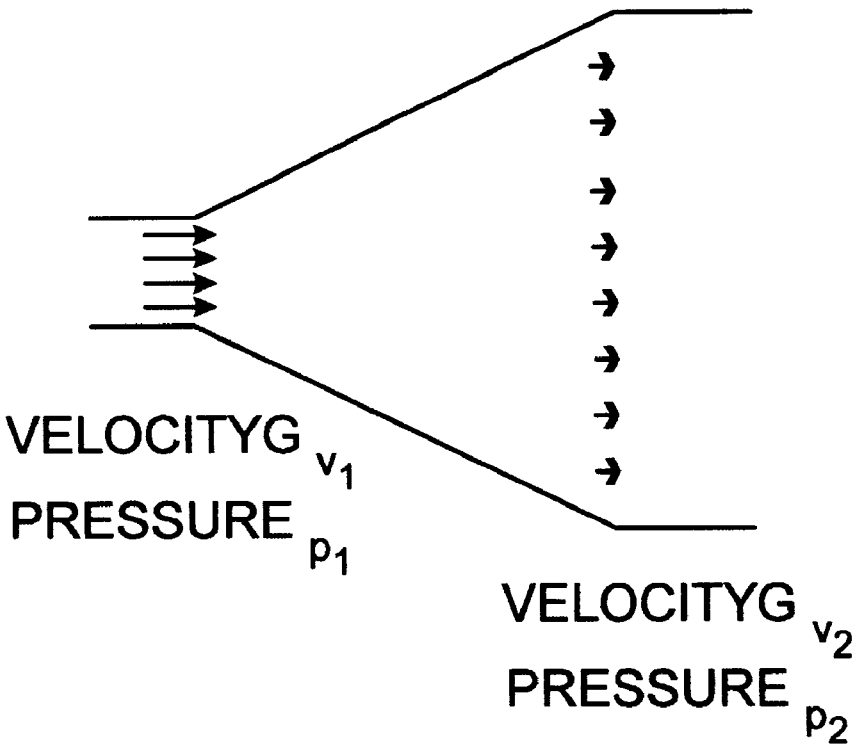
FIG. 9 is a sectional view for explaining how a diffuser works.
Figure 10:
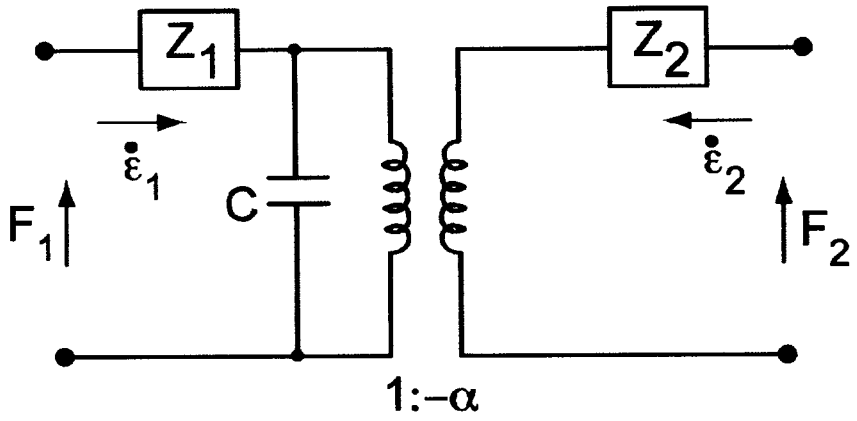
FIG. 10 is a circuit diagram illustrating a basic equivalent circuit of the acoustic sensor according to the present invention.
Figure 11:
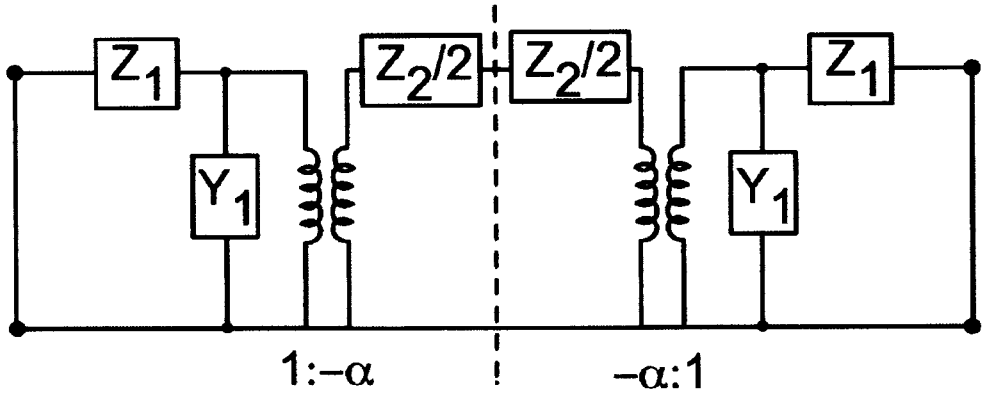
FIG. 11 is a circuit diagram illustrating an equivalent circuit of the acoustic sensor according to one of the embodiments of the present invention illustrated in FIG. 1 and 2 or in FIG. 5 and 6.

FIG. 7 is a block diagram illustrating a typical embodiment of an electronic stethoscope provided with any of the acoustic sensors of the present invention.

A retaining frame 21 holds the acoustic sensor 100 in a vessel 200. The acoustic sensor 100 has a contact piece 22 through which it can directly contact a body to be examined.

An amplifier 24 is mounted in the vessel 200, and commonly connected with the acoustic sensor 100, a battery port 26 via a push-on switch 25, a variable resistor 28 with a dial switch 27 for volume adjustment, an earphone terminal 29 and an external terminal 291.

The electronic stethoscope device of the present invention can be used in medical examinations in the same manner as the conventional stethoscopes.

The amplifier 24 operates when the circuit is energized through the push-on switch 25. The examiner connects an earphone to the earphone terminal 29 so that medical examinations can be made while adjusting the sound volume through the variable resistor 28.

An external storage device can also be connected to the external terminal 29 for data-recording body sounds under examination. Thus, the stethoscope device is designed in consideration of common use of the database of body sounds.

Figure 12:
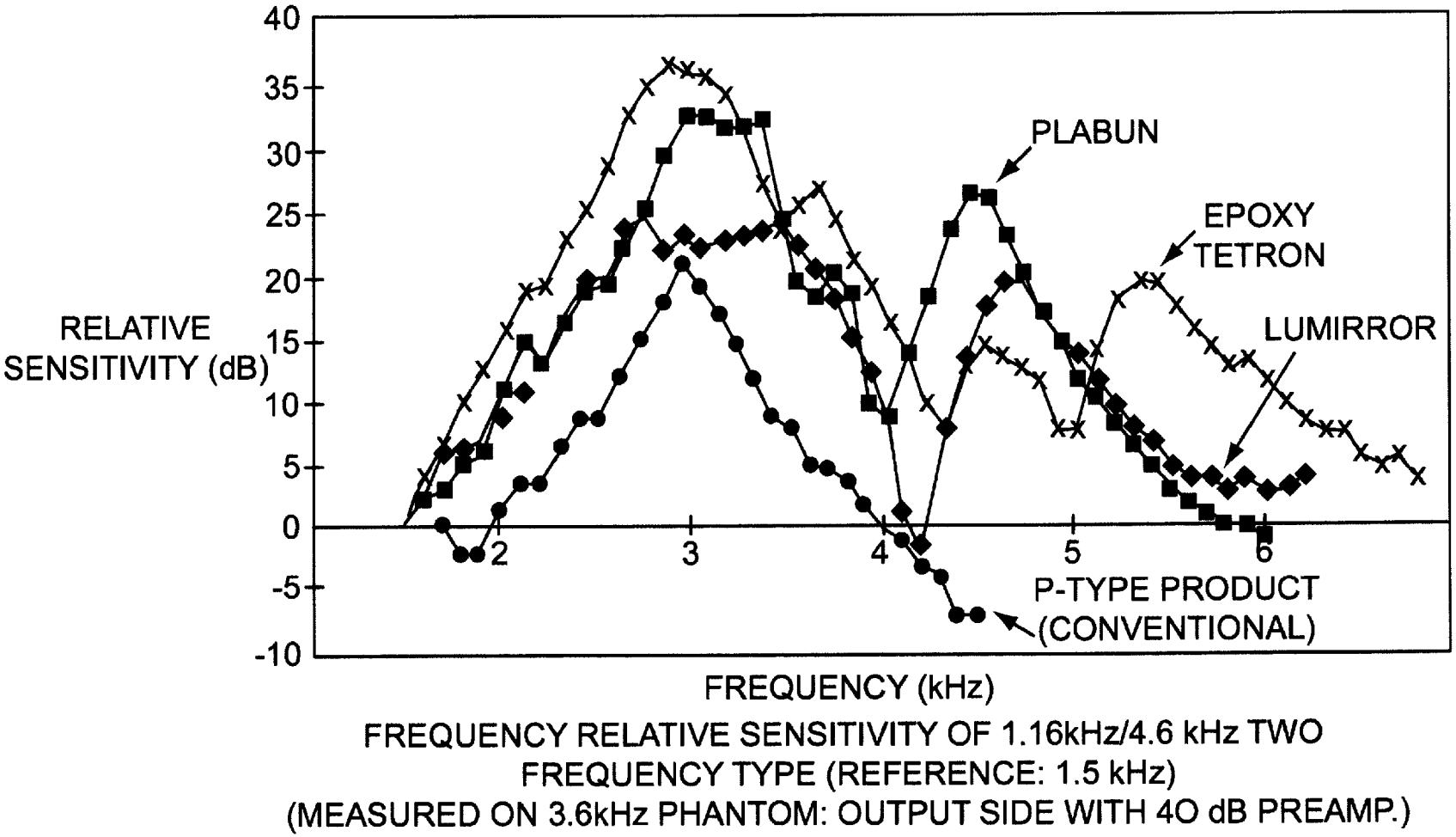
FIG. 12 is a graph illustrating measurement data of frequency relative-sensitivity characteristics of lung sound sensors according to the present invention.

FIG. 12 shows data indicative of frequency relative-sensitivity characteristics obtained from lung sound sensors according to the present invention. The data have been measured on a phantom with a built-in piezoelectric speaker that has an output peak of about 3.6 kHz, but not calibrated for the frequency sensitivity characteristics. For relative comparison, a commercial P-type lung sound sensor (trade name: Op-fon) has been used for measurements under the same conditions as the lung sound sensors of the present invention.

By connecting an amplifier having a gain of 40 dB, the measurements has been made with respect to reference sensitivity to a frequency of 1.5 kHz. It is clear from the results that, while the p-type lung sound sensor remarkably reduces the sensitivity at frequencies of about 4.5 kHz or more, the lung sound sensors of the present invention maintain high sensitivity up to frequencies close to 7 kHz. For relative comparison with the p-type lung sound sensor, sensitivity differences between the lung sound sensors of the present invention and the p-type lung sound sensor have been calculated and are shown in FIG. 13.

It is clear from the results that the lung sound sensors of the present invention maintain high gains of 10 to 20 dB at frequencies of 1.5 to 4.5 kHz.

Figure 13:
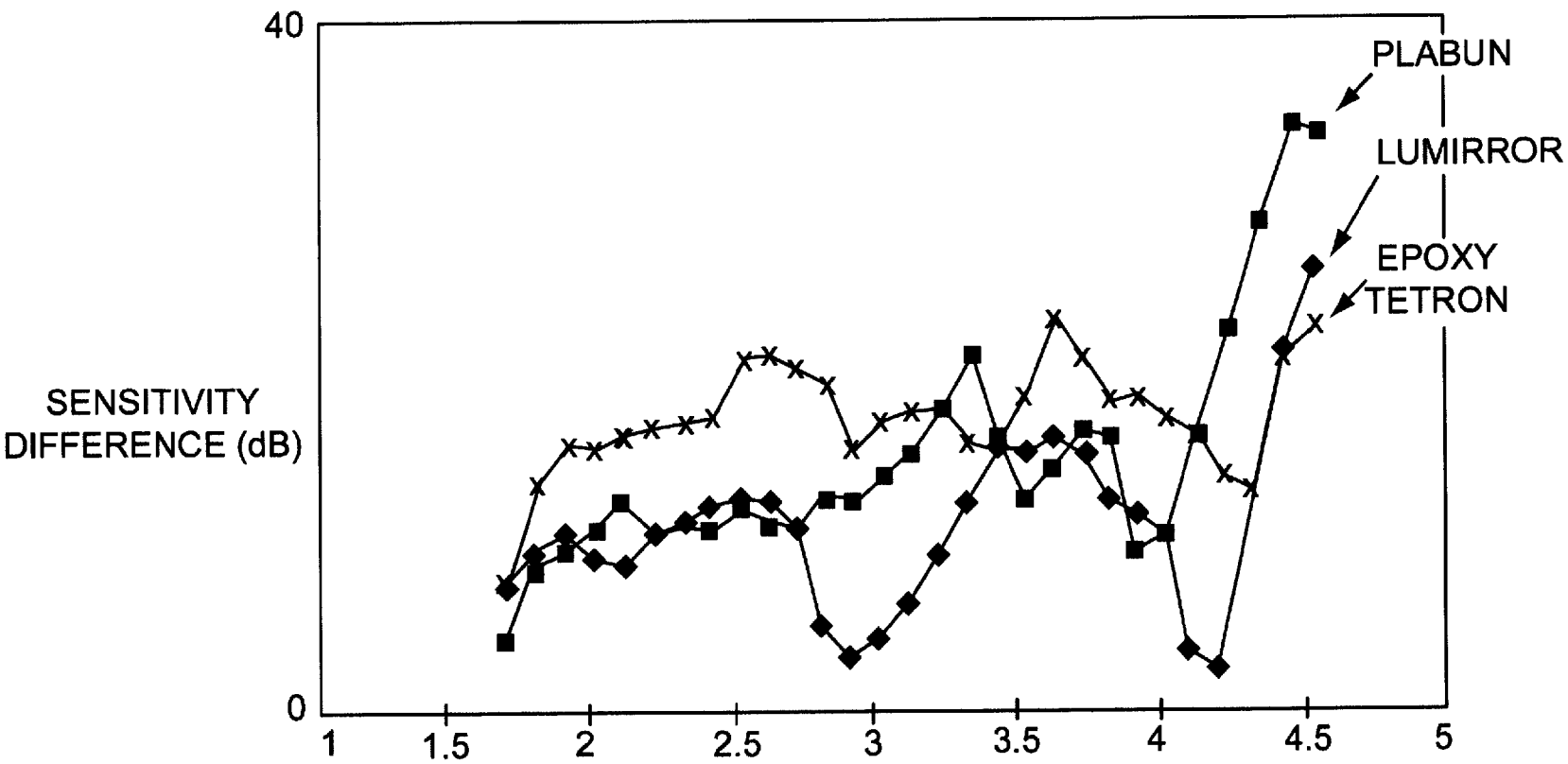
FIG. 13 is a graph illustrating values of differences in relative sensitivity characteristics of FIG. 12, of which data are calculated by subtracting from data of P-type product of FIG. 12.
Figure 14:
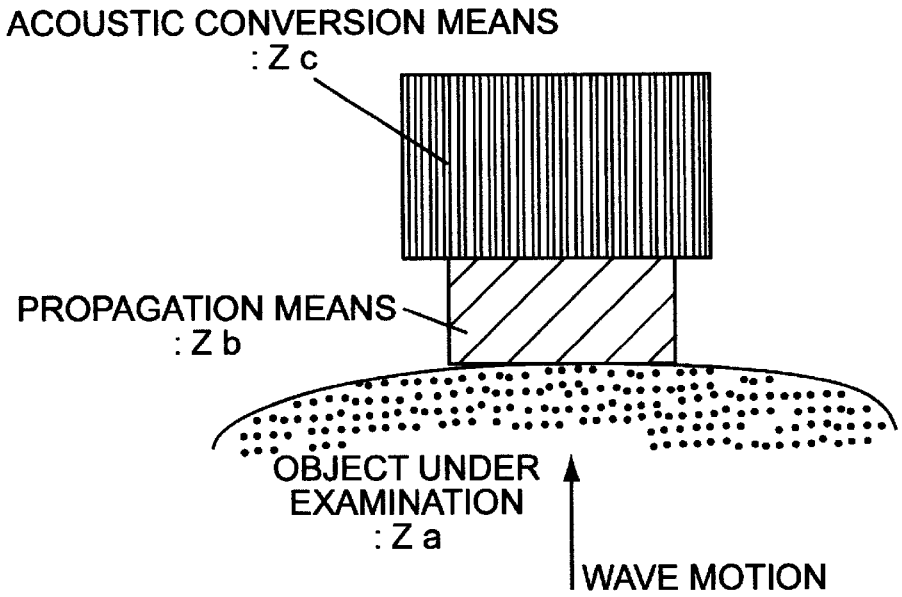
FIG. 14 is a schematic diagram illustrating an acoustic propagation system from a body under examination to an acoustic conversion means.
Figure 15:
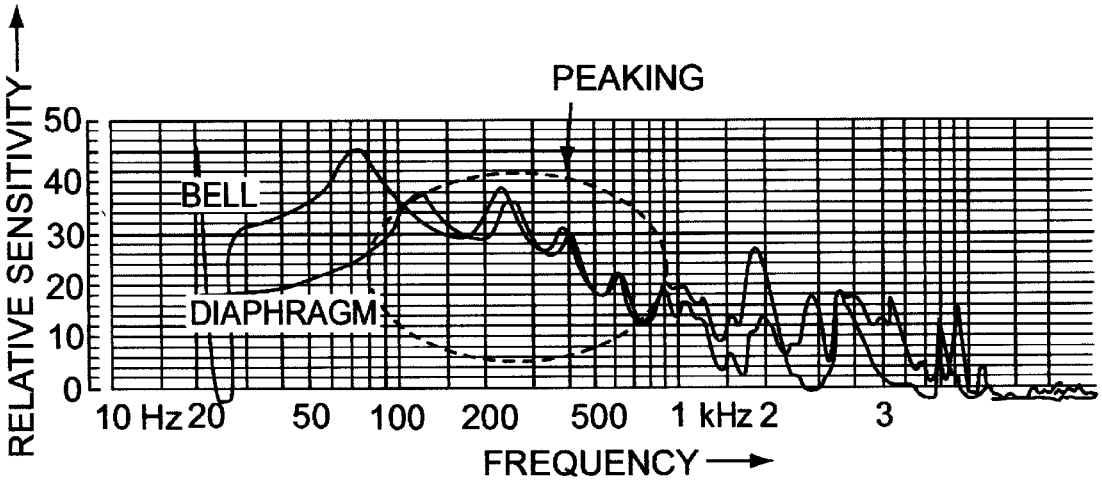
FIG. 15 is a graph illustrating measurements of frequency relative-sensitivity characteristics of a conventional stethoscope.

The characteristics of the lung sound sensors of the present invention, as shown in FIGS. 12 and 13, are obtained in the configuration shown in FIGS. 3 and 4.

The frame is made of acrylic, with the following dimensions: a=17.0 mmϕ, b=21.0 mmϕ and t=6.50 mm. Free-space resonant frequencies of the piezoelectric elements are 1.16 kHz and 4.6 kHz. The piezoelectric substances are made of PZT piezoelectric ceramic with a diameter of 17.0 mmϕ. The membranes are made of Plabun, Epoxy Tetron and Lumirror, respectively, with t=0.2 mm. The electrical Insulating liquid is silicon oil with a sonic velocity of 984 m/s.

For the lung sound sensors of the present invention, the designed value of natural frequency f is 19.2 kHz, and the acoustic impedance ratio is 2.52. Of the measurements of FIG. 12, a peak that is considered to be a frequency peak of the phantom is found in the neighborhood of 3 kHz, and a maximum frequency that is intended to be within the designed value for maximum frequency of the lung sound sensors is found in the neighborhood of 7 kHz, below the natural frequency f=19.2 kHz.

The piezoelectric element is hermetically enclosed in silicon oil, and it is considered to operate like a liquid Langevin transducer using silicon oil. From this standpoint, the free-space resonant frequency (series resonance frequency) of the piezoelectric element does not concern the design factor. It is apparent from this point that the acoustic sensor of the present invention can display high sensitivity in detecting examined body sounds of wide-band frequencies in a non-resonant state, ranging from low sound to high sound frequencies.

Figure 16:
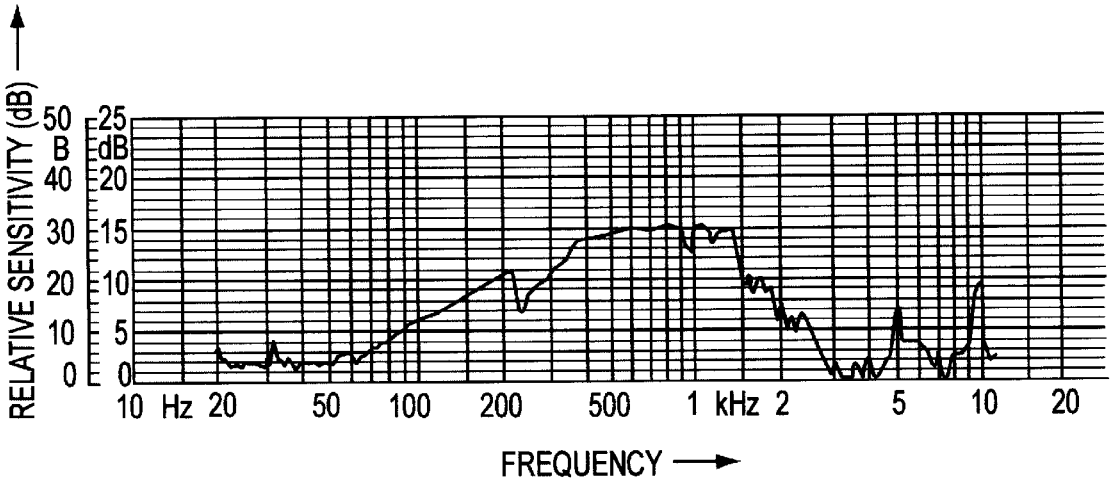
FIG. 16 is a graph illustrating measurements of frequency relative-sensitivity characteristics of the electronic stethoscope device of FIG. 17 according to the present invention.

FIG. 16 shows data indicative of frequency relative-sensitivity characteristics of the electronic stethoscope device of the present invention.

The data has been measured relative to frequency sensitivity characteristics of a conventional stethoscope device. As shown, relatively flat characteristics are found at frequencies of between 200 Hz and 2 kHz. Although small dips are found in the low sound range, it is considered that a phase difference (time difference) between the piezoelectric elements during sound transmission from the input-side membrane 12 of the acoustic sensor to the respective piezoelectric elements Just causes eliminator-like dips.

The acoustic sensor used in the electronic stethoscope device has the configuration shown in FIGS. 3 and 4. The frame is made of acrylic, with the following dimensions: a=22.0 mmϕ, b=26.0 mmϕ and t=6.50 mm. Free-space resonant frequencies of the piezoelectric elements are respectively 1.3 kHz and 1.3 kHz. The piezoelectric substances are made of PZT piezoelectric ceramic with a diameter of 22.0 mmϕ. The membranes are made of Plabun with t=0.2 mm. The electrical insulating liquid is silicon oil with a sonic velocity of 984 m/s.

For the electronic stethoscope device, the designed value of natural frequency f is 20.2 kHz, and the acoustic impedance ratio is 2.40. Of the measurements of FIG. 16, a dip is recognized in the neighborhood of 200 Hz, and a maximum frequency that is intended to be the designed value exists in the neighborhood of anti-resonance frequencies of the piezoelectric elements.

Figure 17:
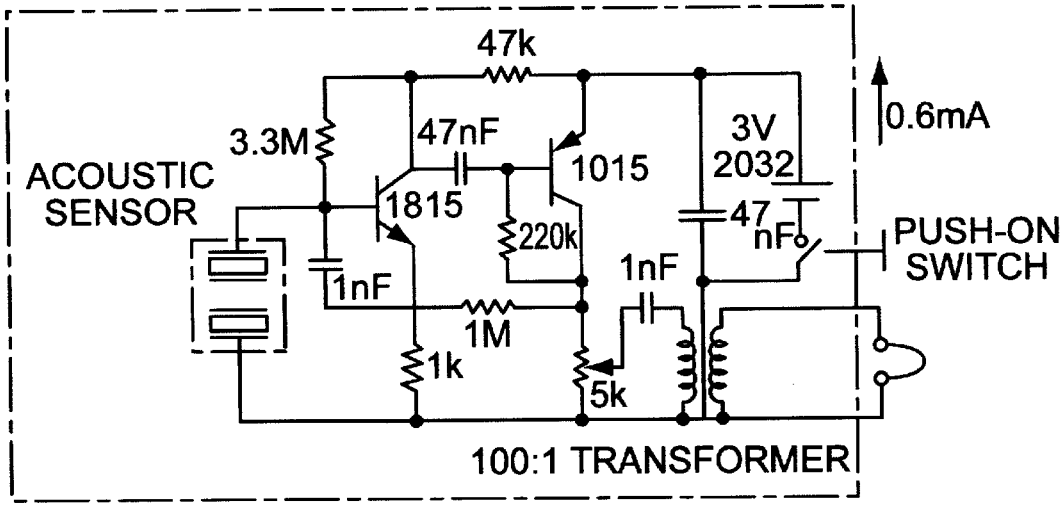
FIG. 17 is a circuit diagram illustrating an embodiment of an electric circuit of the electronic stethoscope device according to the present invention.

FIG. 17 shows an electric circuit of the stethoscope of FIG. 16. A two-stage-transistor amplifier can obtain a gain of 40 dB; it is connected with a 3V button-battery, a push-on switch and the acoustic sensor of the present invention. The entire circuit is assembled as one body in a proper case.

According to the present invention, the acoustic sensor and the electronic stethoscope device provided with the acoustic sensor are such that a sound directly transmitted from a body under examination travels through the electrical insulating liquid hermetically enclosed in the frame, not through an air layer, so that acoustic impedance matching and velocity-pressure conversion can be effective in outputting an electric signal rationally.

The configurations of the present invention can dramatically reduce ambient noise under auscultation; it no longer requires quiet auscultation surroundings.

Further, the detection principle is not based on resonance of the piezoelectric element, so that flat frequency sensitivity characteristics can be obtained in a wide band from the low sound frequency range up to the anti-resonance frequencies of the piezoelectric elements existing in the high sound frequency range, lower than the natural frequency of the sensor, while maintaining high sensitivity.

What is claimed is:

1. An acoustic sensor comprising:

a piezoelectric element including a piezoelectric substance on which at least one electrode is provided, and a diaphragm on which said piezoelectric substance is mounted and supported;

a membrane capable of vibrating, which is arranged in a position opposite to said diaphragm;

a frame which is so horn-shaped that the interior space is enlarged from the edge of said membrane to the edge of said diaphragm;

a cell constituted by arranging said frame in such a way as to house said diaphragm therein, expose said membrane to the outside, and enclose an electrical insulating liquid hermetically therein; and a lead connected to said electrode and drawn out from said electrode to the outside of said frame.

2. An acoustic sensor comprising:

a piezoelectric element constituted of first and second piezoelectric substances, each of which has at least one electrode thereon, and a diaphragm sandwiched between said first and second piezoelectric substances so that said first and second piezoelectric substances are supported;

a pair of membranes capable of vibrating, which are arranged in positions opposite to said diaphragm;

a frame which is so horn-shaped that the interior space is enlarged from the edges of said pair of membranes to the edges of said diaphragm;

a cell constituted by arranging said frame in such a way as to house said diaphragm therein, expose said membranes to the outside, and enclose an electrical insulating liquid hermetically therein; and a pair of leads respectively connected to said electrodes and drawn out from said electrodes to the outside of said frame.

3. An acoustic sensor comprising:

a first piezoelectric element constituted of a first piezoelectric substance on which at least,one electrode is provided, and a first diaphragm on which said first piezoelectric substance is mounted and supported;

a second piezoelectric element constituted of a second piezoelectric substance on which at least one electrode is provided, and a second diaphragm on which said second piezoelectric substance is mounted and supported;

a pair of membranes capable of vibrating, which are arranged in positions opposite to said first and second diaphragms, respectively;

a frame which is so horn-shaped that the interior space is enlarged from the edges of said pair of membranes to the edges of said first and second diaphragms, respectively;

a cell constituted by arranging said frame in such a way as to house said diaphragm therein, expose said membranes to the outside, and enclose an electrical insulating liquid hermetically therein; and a pair of leads respectively connected to said electrodes and drawn out from said electrodes to the outside of said frame.

4. An electronic stethoscope device incorporating therein the acoustic sensor as set forth in any one of claims 1 through 3.

* * * * *